US006976326B2

(12) United States Patent
Tajima et al.

(10) Patent No.: US 6,976,326 B2
(45) Date of Patent: Dec. 20, 2005

(54) CLIP FOR EMBROIDERY FRAME

(75) Inventors: Ikuo Tajima, Kasugai (JP); Aisuke Murase, Kasugai (JP); Isao Ohashi, Kasugai (JP)

(73) Assignee: Tokai Kogyo Mishin Kabushiki Kaisha, Aichi (JP)

( * ) Notice: Subject to any disclaimer, the term of this patent is extended or adjusted under 35 U.S.C. 154(b) by 532 days.

(21) Appl. No.: 10/257,236

(22) PCT Filed: May 1, 2001

(86) PCT No.: PCT/JP01/03785

§ 371 (c)(1),
(2), (4) Date: Oct. 9, 2002

(87) PCT Pub. No.: WO01/86051

PCT Pub. Date: Nov. 15, 2001

(65) Prior Publication Data

US 2003/0074815 A1 Apr. 24, 2003

(30) Foreign Application Priority Data

May 8, 2000 (JP) ..... 2000-135039

(51) Int. Cl.[7] ..... D06C 3/08
(52) U.S. Cl. ..... 38/102.91; 38/102.2
(58) Field of Search ..... 38/102.91, 102.2, 38/102.1, 102.21, 102.8; 160/375, 378, 381, 382, 380, 383, 399, 401, 402; 140/82; 101/127.1; 16/87.2; 24/270, 236, 24, 67.5, 330, 570

(56) References Cited

U.S. PATENT DOCUMENTS

| | | | | | |
|---|---|---|---|---|---|
| 1,484,382 | A | * | 2/1924 | Berry | 24/462 |
| 3,950,869 | A | * | 4/1976 | Samarin | 38/102.91 |
| 4,614,997 | A | * | 9/1986 | Montet | 362/549 |
| 5,355,792 | A | * | 10/1994 | MacNaughton et al. | 101/127.1 |
| 5,586,400 | A | * | 12/1996 | Moore, III | 38/102.2 |
| 6,405,411 | B1 | * | 6/2002 | Allemann et al. | 24/19 |

FOREIGN PATENT DOCUMENTS

| | | | |
|---|---|---|---|
| JP | 63-182465 | * | 7/1988 |
| JP | 1-39743 | | 11/1989 |
| JP | 2581912 | | 11/1996 |

* cited by examiner

*Primary Examiner*—Ismael Izaguirre
(74) *Attorney, Agent, or Firm*—Koda & Androlia

(57) ABSTRACT

Provided is an embroidery frame clip which can effectively prevent itself, without marring operability of fitting it to an embroidery frame, from slipping off the frame, when the tension of an embroidering cloth is increased as stitching goes on. The embroidery frame clip is designed to hold an embroidering cloth a in tension over a rectangular embroidery frame 1 by clipping the cloth a between a rail 2 formed on an upper surface of the embroidery frame circumferentially along the inner rim thereof and the clip fitted on the rail 2. The clip has a clip main body 6 to be fitted on the rail 2 and auxiliary members 7 attached to the clip main body 6, for preventing the clip main body 6 from deforming to open as stitching of the embroidering cloth goes on.

1 Claim, 8 Drawing Sheets

CLIP FOR EMBROIDERY FRAME

TECHNICAL FIELD TO WHICH THE INVENTION BELONGS

The present invention relates to a clip for an embroidery frame for holding an embroidering cloth in tension over the embroidery frame having a rectangular shape.

PRIOR ART

When an embroidering cloth is to be embroidered, for example, with an embroidering machine, the cloth needs to be stretched over an embroidery frame. In the case where a large embroidering cloth such as a whole cloth is to be stretched over a rectangular embroidery frame, there is employed a method of clipping the embroidering cloth onto the embroidery frame by fitting a plurality of clips onto a rail formed circumferentially along the inner rim of the embroidery frame. More specifically, the clips are each made using a resilient plate material such as a spring steel plate and by bending the plate material into a tubular shape such that it may form an opening on the circumference thereof. Referring to the use of the clip, an embroidering cloth is spread over the embroidery frame, and then each clip is pressed down against the rail with the opening being abutted thereto through the cloth to be engaged resiliently with the rail, thus stretching the cloth in tension over the embroidery frame.

PROBLEMS TO BE SOLVED BY THE INVENTION

The embroidery frame is moved on a table of an embroidering machine in synthesized directions of X-Y coordinates based on embroidery data from a computer to apply stitching onto the embroidering cloth in cooperation with the movement of a needle bar provided in the machine head. However, the embroidering cloth is caused to shrink due to puckering as stitching goes on, so that the tension to be applied to the embroidering cloth increases gradually. Such increase of tension opens each clip little by little against the resilience thereof, and there is a possibility that, in the worst case, the clip disengages from the rail with further progression of stitching to release retention of the embroidering cloth from the embroidery frame.

In order to overcome the inconvenience described above, the clip may be allowed to have an increased rigidity. In this case, however, it requires a great force for an operator to fit the clip on the rail of the embroidery frame. Therefore, the operation of fitting the clip on the rail takes much trouble and can be rather difficult for a frail operator like a woman.

OBJECT OF THE INVENTION

The present invention, which was accomplished in view of the inconveniences as described above and with a view to solving them suitably, is directed to providing an embroidery frame clip capable of effectively preventing itself from slipping off the frame against the tension of an embroidering cloth increasing as stitching goes on, without marring clipping operability.

MEANS FOR SOLVING THE PROBLEMS

In order to overcome the problems as described above and to attain the intended object suitably, the present invention provides an embroidery frame clip for holding an embroidering cloth in tension over a rectangular embroidery frame by clipping the cloth between a rail formed on an upper surface of the embroidery frame circumferentially along an inner rim thereof and the clip fitted on the rail; the clip comprising a clip main body to be fitted on the rail; and an auxiliary member attached to the clip main body, for preventing the clip main body from deforming to open as stitching of the embroidering cloth goes on.

ACTION

If the clip main body is deformed to open by the tension of the embroidering cloth increased as stitching goes on, the deformation of the clip main body is prevented by the auxiliary members attached thereto.

MODE FOR CARRYING OUT THE INVENTION

Figure 1:
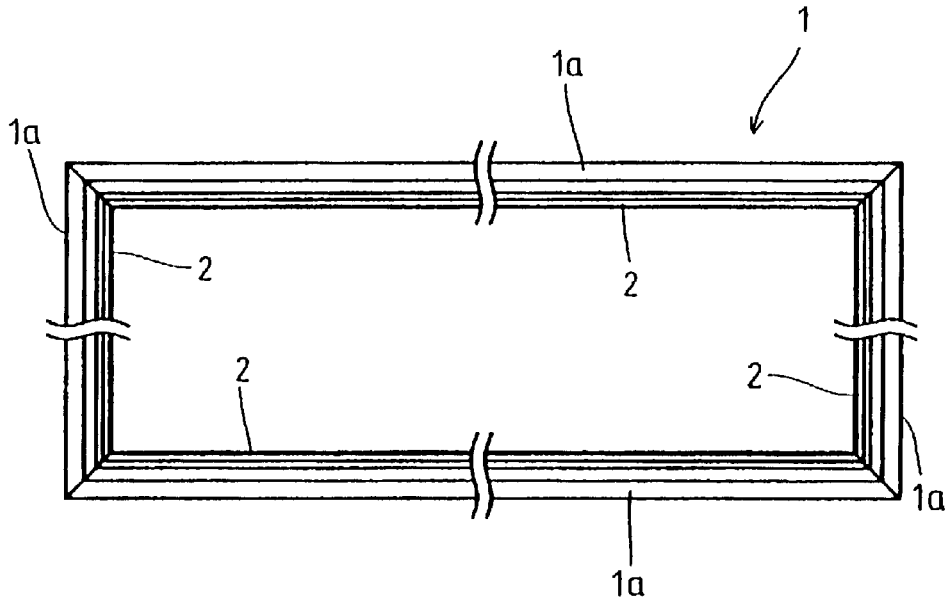
FIG. 1 is a plan view of the embroidery frame.
Figure 7:
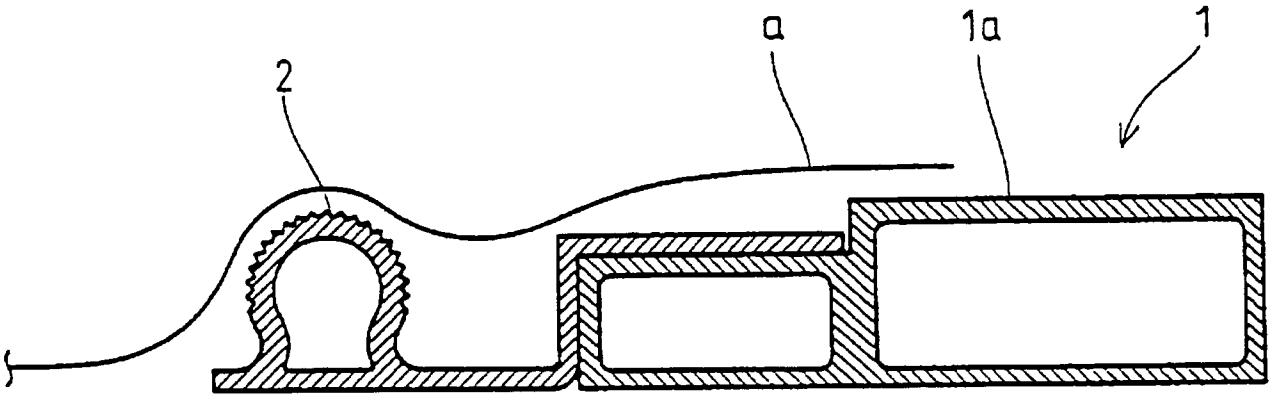
FIG. 7 is a vertical cross-sectional view of the embroidery frame.

Next, the embroidery frame clip according to another aspect of the present invention will be described below by way of a preferred embodiment referring to the attached drawings. FIG. 1 is a plan view of the embroidery frame 1 for which the embroidery frame clip of the embodiment is used. The embroidery frame 1 having a rectangular shape is provided with a rail 2 formed circumferentially along the inner rim of the frame. More specifically, as is clearly shown in FIG. 7 illustrating a vertical cross section of the embroidery frame, a rail 2 having a hollow circular cross section is formed on the top surface of the inner rim in each frame member 1*a* of the embroidery frame 1.

Figure 2:
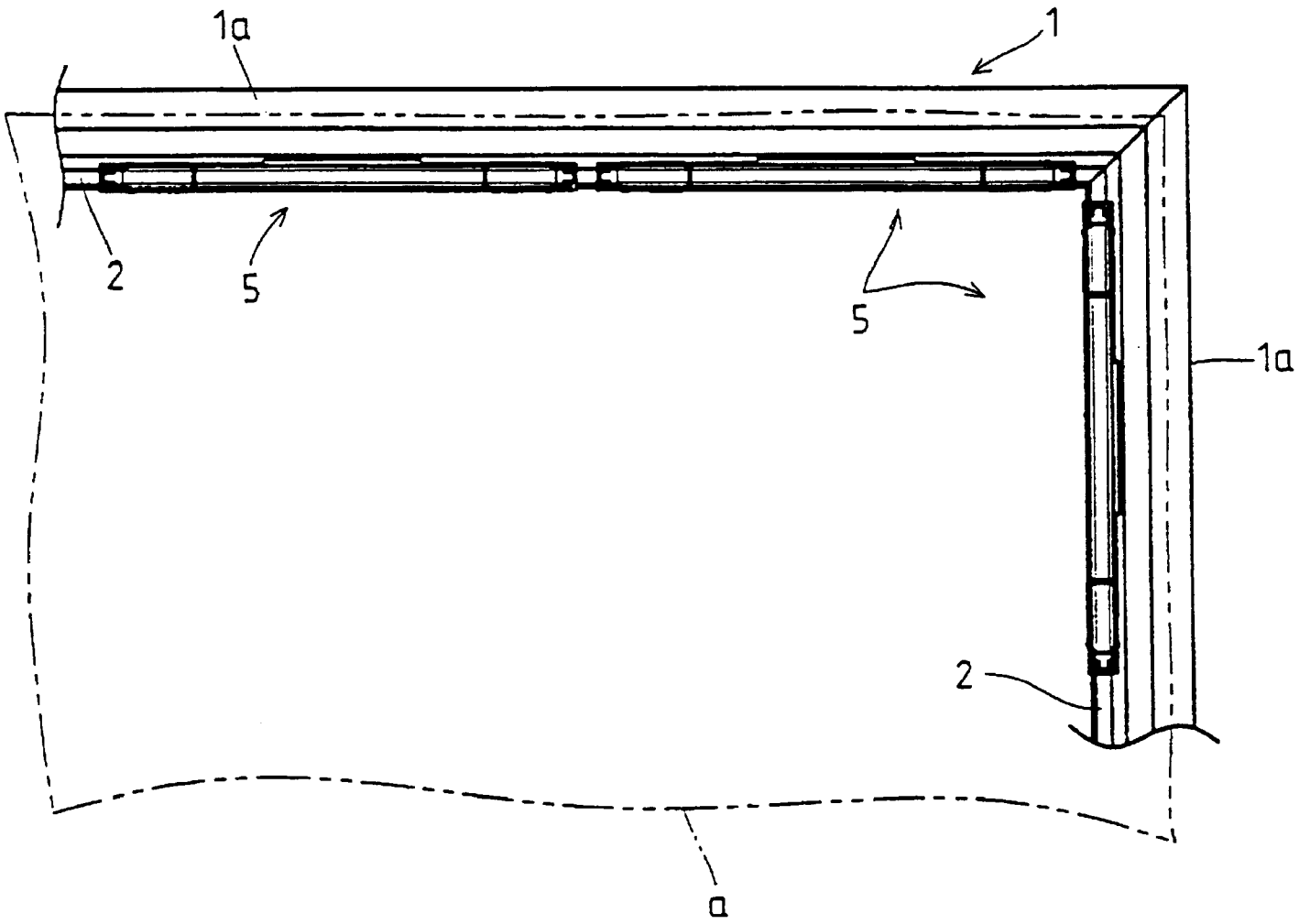
FIG. 2 is a partial plan view showing a state where an embroidering cloth is held in tension over the embroidery frame shown in FIG. 1.
Figure 3:
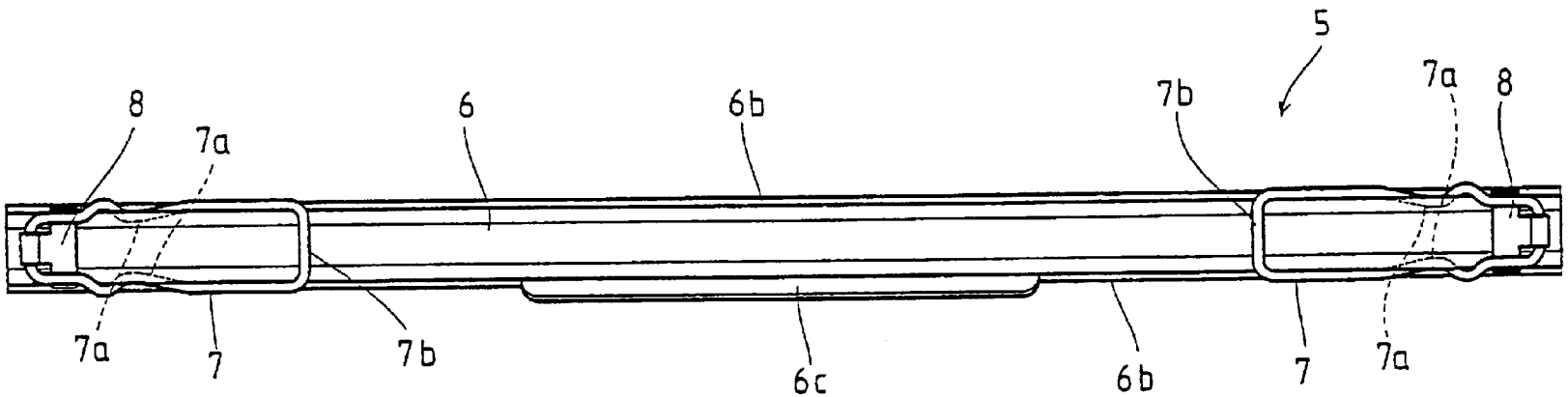
FIG. 3 is a plan view of the embroidery frame clip according to a preferred embodiment of the present invention.
Figure 4:
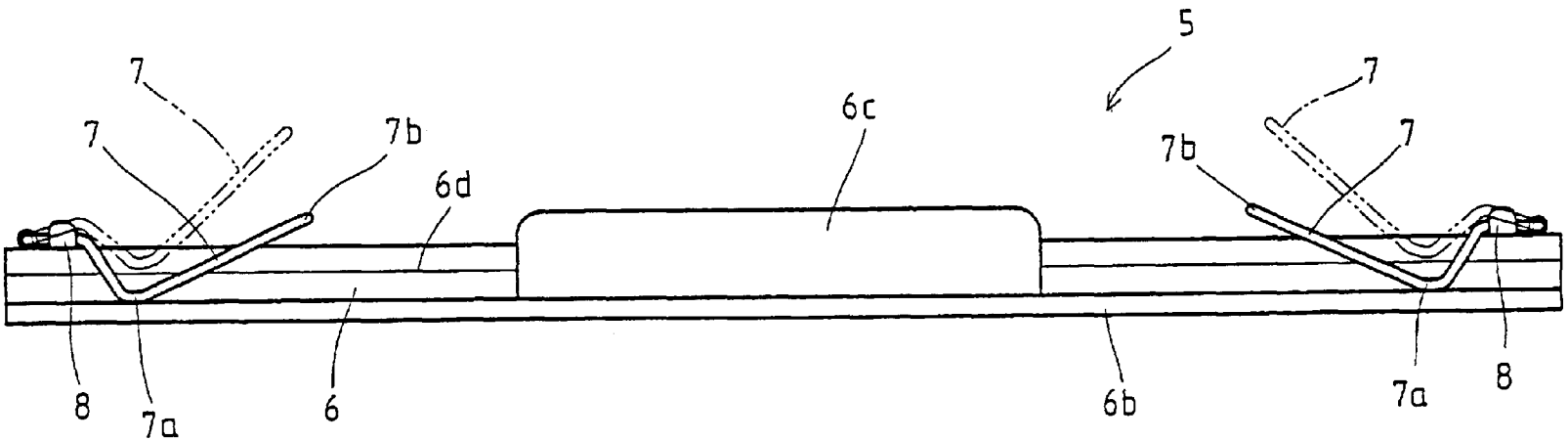
FIG. 4 is a side view of the embroidery frame clip shown in FIG. 3.

After an embroidering cloth a, indicated by the chain double-dashed line, is spread over the embroidery frame 1, embroidery frame clips 5 according to the present invention are fitted on the rail 2 through the embroidering cloth a, as shown in FIG. 2. Thus, the embroidering cloth a is held in tension over the embroidery frame 1. Here, FIG. 3 is a plan view of the embroidery frame clip 5; and FIG. 4 is a side view thereof. As can be understood from FIGS. 3 and 4, the embroidery frame clip 5 consists essentially of a clip main body 6 which can be fitted on the rail 2 of the embroidery frame 1, and a pair of auxiliary members attached to the upper surface of the main body 6 at each end portion thereof.

Figure 5:
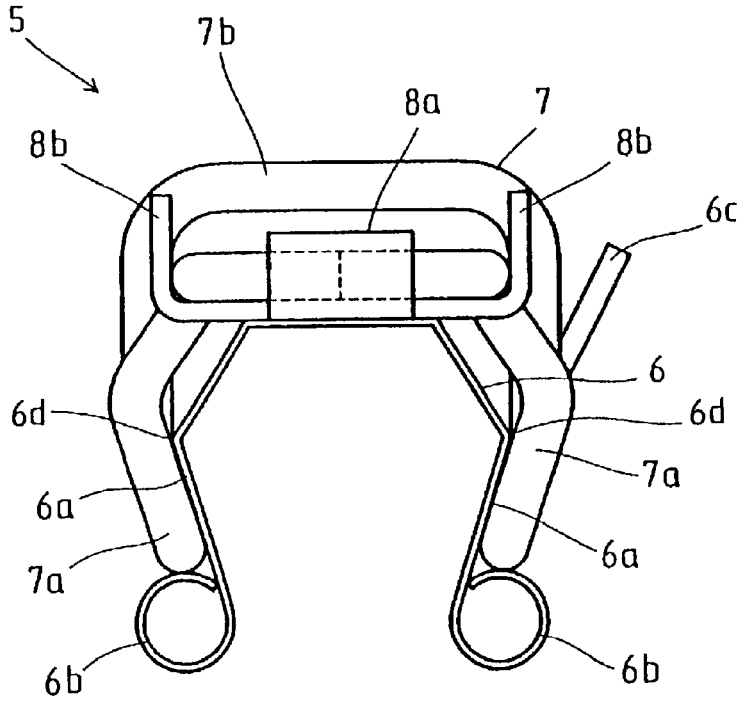
FIG. 5 is an enlarged front view of the embroidery frame clip.
Figure 6:
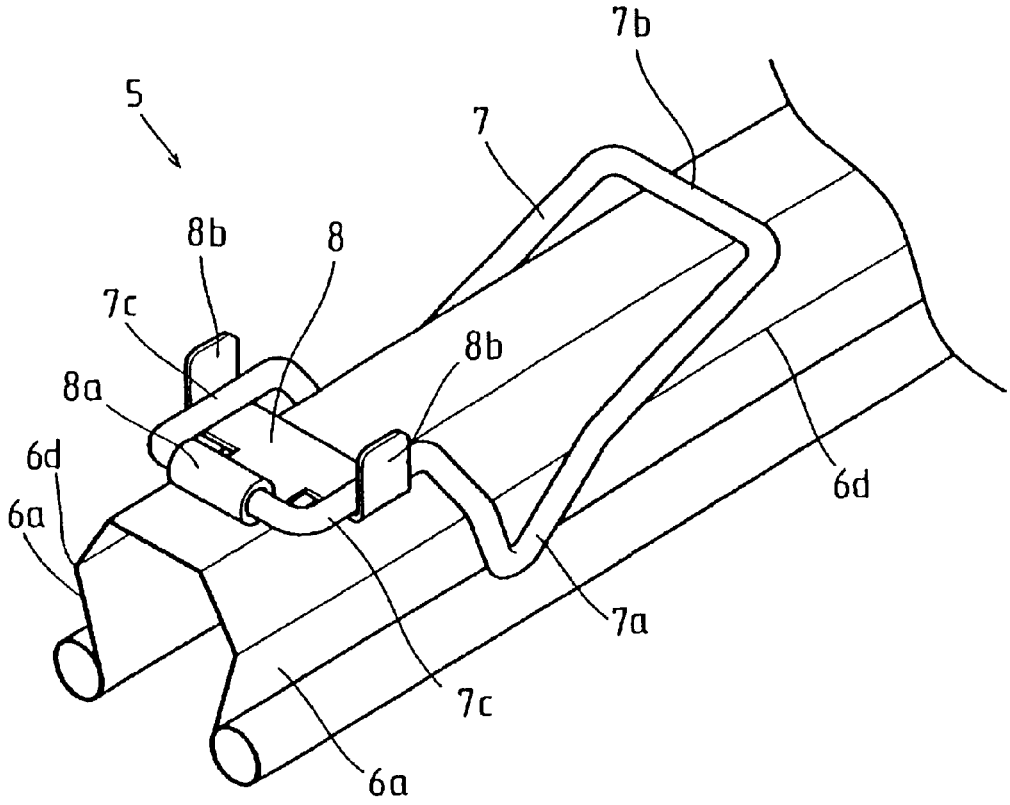
FIG. 6 is a partial, enlarged perspective view of the embroidery frame clip.
Figure 8:
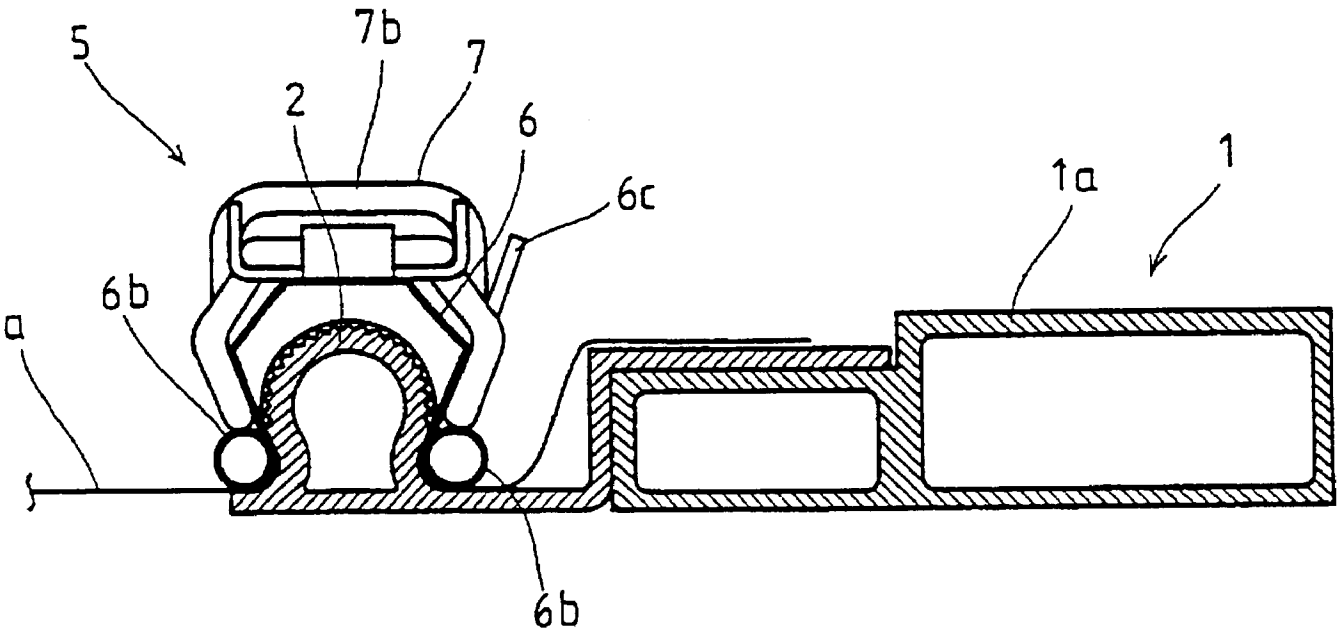
FIG. 8 is a cross-sectional view showing a state where an embroidering cloth is held in tension over the embroidery frame using the embroidery frame clips.

The clip main body 6 is formed by bending longitudinally a predetermined length of spring steel plate such that it has a pentagonal cross section and that opposing edges are spaced away from each other by a predetermined distance and form a pair of legs 6*a*, 6*a*, as shown in FIGS. 5 and 6. Further, the lower ends of the legs 6*a*, 6*a* of the clip main body 6 are curled outward as shown in FIG. 5 to form fitting portions 6*b*, 6*b* that are to be fitted substantially tightly to the root of the rail 2 of the embroidery frame 1, as shown in FIG. 8. The distance between the fitting portions 6*b*, 6*b* is designed to be smaller than the thickness of the root of the rail 2. Further, as shown in FIGS. 3 and 4, the clip main body 6 has on one lateral side a handle 6*c* serving as a gripper to be used when the embroidery frame clip 5 is removed.

Next, the auxiliary members 7 to be attached to the top surface of the clip main body 6 at each end portion thereof are each formed by bending a spring steel wire into a loop, as shown in FIG. 6. Abutting portions formed by the ends of the looped wire are inserted to a supporting portion 8*a* of a seat 8 fixed onto the upper surface of the clip main body 6 by means of spot welding and the like. Thus, the auxiliary members 7 are connected swingably to the clip main body 6. Each auxiliary member 7 is attached astride to the clip main body 6. Each auxiliary member 7 has on both sides a pair of engaging portions 7*a*, 7*a* formed by bending the loop inward. These engaging portions 7*a*, 7*a* hold between them the clip main body 6 along the legs 6*a*, 6*a* thereof, when the auxiliary member 7 is assuming a locking posture as indicated by the solid line in FIG. 4. Further, the loop has a grip 7*b* formed integrally therewith, as shown in FIG. 6. The grip 7*b* lifts a little from the upper surface of the clip main body 6 when the auxiliary member 7 is assuming the locking posture. Meanwhile, the seat 8 has a pair of regulating walls 8*b*, 8*b* for regulating proximal portions 7*c*, 7*c* located on each side of the auxiliary member 7 not to be pulled away from each other, when the auxiliary member 7 is in the locking state as indicated by the solid line in FIG. 4.

Next, practical use of the embroidery frame clip according to this embodiment will be described. In order to allow the embroidery frame 1 to hold an embroidering cloth a in tension, the cloth a is spread over the embroidery frame 1, and then embroidery frame clips 5 of this embodiment are fitted on the rails 2 of the respective frame members 1*a* in the embroidery frame 1 through the cloth a, as shown in FIG. 2, which are procedures as have been practiced conventionally. In this embodiment, however, when each embroidery frame clip 5 is to be fitted, the auxiliary members 7 attached to both end portions of the clip main body 6 are unlocked by pulling them up as indicated by the chain double-dashed line in FIG. 4.

Next, as shown in FIG. 7, the embroidery frame clips 5 are fitted to the rail 2 by pressing them forcefully against the rail 2 through the embroidering cloth a. Then, as indicated by the solid lines in FIGS. 4 and 8, the auxiliary members 7, 7 are locked by pressing them down. More specifically, when the auxiliary members 7 are turned down by pushing them down with fingers, the pair of engaging portions 7*a*, 7*a* in each auxiliary member 7 are engaged with a pair of angled pieces 6*d*, 6*d* (FIG. 6) extending longitudinally on the lateral sides of the clip main body 6, so that both the engaging portions 7*a* and the angled pieces 6*d* are deformed to open. Then, at the point that the engaging portions 7*a*, 7*a* are abutted against the corresponding fitting portions 6*b*, 6*b* respectively, as shown in FIGS. 5 and 8, the auxiliary member 7 resiliently restores to its original state, and the proximal portions 7*c*, 7*c* located on each side of the auxiliary member 7 are brought into contact with the inner surfaces of the pair of regulating walls 8*b*, 8*b* respectively.

When the embroidering cloth a is fully held in tension over the embroidery frame 1 as described above and an embroidering machine (not shown) starts stitching operations, the tension of the embroidering cloth a increases as stitching goes on as explained already to exert a force of pulling the legs 6*a* of the clip main body 6 in each embroidery frame clip 5 away from each other. However, in the embroidery frame clip 5 of this embodiment, the legs 6*a* are embraced with the engaging portions 7*a* of each auxiliary member 7, so that the legs 6*a* are prevented effectively from deforming to open. In other words, even if the tension of the embroidering cloth a is increased, there occurs neither disengagement of the embroidery frame clips 5 from the rail 2 nor lifting of the fitting portions 6*b* on the inner side of the clip main body 6 to raise the embroidering cloth a.

Meanwhile, when the embroidery frame clip 5 is to be removed from the rail 2, the grip 7*b* of each auxiliary member 7 is pulled up by gripping it. Then, the handle 6*c* of the clip main body 6 is tilted endways, and the clip 5 can be removed easily with no might. Here, each auxiliary member 7, 7 in this embodiment can be detached from the seat 8, if it is pulled up beyond the posture indicated by the imaginary line (chain double-dashed line) in FIG. 4 until the proximal portions 7*c* are disengaged from the regulating walls 8*b* of the seat 8, respectively, and the proximal portions 7*c* are pulled away from each other. Therefore, in the case where the auxiliary members 7 are not necessary, they may be detached from the clip 5 as explained above, and the resulting clip 5 can be used in the like manner as the conventional clips are used.

EFFECT OF THE INVENTION

As has been described heretofore, the embroidery frame clip according to the present invention does not slip off the frame, since the auxiliary members attached to the clip main body prevent the clip main body from deforming to open even if the tension of the embroidering cloth is increased as stitching goes on to exert a force of deforming the clip main body to open. Thus, the clips can securely hold the embroidering cloth in tension over the embroidery frame until stitching operations complete.

What is claimed is:

1. An embroidery frame clip for holding an embroidering cloth in tension over a rectangular embroidery frame by clipping the cloth between a rail formed on an upper surface of the embroidery frame circumferentially along an inner rim thereof and the clip fitted on the rail; the clip comprising:

a clip main body to be fitted on the rail; and an auxiliary member attached to the clip main body, for preventing the clip main body from deforming to open as stitching of the embroidering cloth goes on.

* * * * *